United States Patent [19]

Kamiya

[11] 4,236,284

[45] Dec. 2, 1980

[54] SOLID SLIDE FASTENER CAPABLE OF EFFECTING STRONG UNION

[76] Inventor: Minoru Kamiya, 46-3, 2-chome, Minami Otsuka, Toshima-ku, Tokyo, Japan

[21] Appl. No.: 886,825

[22] Filed: Mar. 15, 1978

[30] Foreign Application Priority Data

Sep. 26, 1977 [JP] Japan ..... 52-115322

[51] Int. Cl.[3] ..... A44B 19/06; A44B 19/26

[52] U.S. Cl. ..... 24/205.13 R; 24/205.15 R

[58] Field of Search ..... 24/205.13 R, 205.12, 24/205.15 R, 205 R

[56] References Cited

U.S. PATENT DOCUMENTS

| | | | |
|---|---|---|---|
| 504,037 | 8/1893 | Judson | 24/205 R |
| 2,013,071 | 9/1935 | Sipe | 24/205 R |
| 2,347,428 | 4/1944 | Morin | 24/205.13 R |
| 2,554,929 | 5/1951 | Sundback | 24/205.13 R |
| 2,652,611 | 9/1953 | Jaster | 24/205.15 R |
| 3,334,387 | 8/1967 | Gauthier | 24/205.13 R |
| 3,825,978 | 7/1974 | Sakalys | 24/205.13 R |
| 3,874,038 | 4/1975 | Takamatsu | 24/205.13 R |

FOREIGN PATENT DOCUMENTS

| | | | |
|---|---|---|---|
| 502393 | 4/1951 | Belgium | 24/205.13 R |

*Primary Examiner*—Kenneth Dorner

*Attorney, Agent, or Firm*—Brisebois & Kruger

[57] ABSTRACT

A solid slide fastener capable of effecting strong union which carries out the engagement and disengagement of fastening elements from right-angle direction with respect to a direction where external force is mainly given to tapes at the connection of the elements, and which can maintain strong connection by completely avoiding the escape of the elements towards the direction of tapes.

4 Claims, 20 Drawing Figures

PRIOR ART

SOLID SLIDE FASTENER CAPABLE OF EFFECTING STRONG UNION

BACKGROUND OF THE INVENTION

1. Field of the Invention

This invention relates to a solid slide fastener by which strong union is obtained and more particularly to a solid slide fastener which does not disengage against a direction in which tensile force is given.

2. Brief Description of the Prior Art

In general, a slide fastener is equipped with a plurality of fastening elements in row along the inside edges of a pair of slender tapes. It is so constructed that opposed fastening elements on both tapes are joined together or disengaged from one another by sliding a slider adapted to the fastening elements along the rows of the elements. This type of a slider fastener enjoys various use, for example, clothing, pouch, sporting uniform, household articles.

However, the conventional slide fastener in which the union of opposed fastening elements of a pair of tapes is carried out on the same plane of the tapes by placing the elements opposite and engaging them, has such fatal defects that when external force is acted in a direction where the both tapes are released, the joint of the fastening elements is easily disengaged by comparatively small force. When the union of the elements is once separated forcedly, it is very difficult to restore the union of the elements to the initial status.

Therefore, it becomes impossible to wear again a clothing itself which uses this fastener.

SUMMARY OF THE INVENTION

A principal object of the present invention is to widely enlarge the usage range of a fastener which is limited to use of opening or closing mechanism in clothing, pouch, etc. to which comparatively small external force is only added, and to provide a solid slider fastener which is usable as joining fastener to be provided on some portion of general industrial parts, to which strong tensile force is given.

Another object is to provide a solid slide fastener having no variation of joining force due to local abrasion and good durability.

Still another object is to provide a solid slide fastener with strong joint in which the joint of the fastening elements on both tapes is not disengaged even when tensile force is given to in a direction where the both tapes are separated, at the joining of the fastener, by differing a direction of a main tensile force which is given to tapes of the joined fastener and an engaging direction of the fastening elements, and moreover, by crossing the both directions at right angle.

Still another object is to provide a solid slide fastener which can make strong joint by providing flanges engaging with the opposed elements and grooves for the flanges on upper surfaces or below surfaces of the both fanstening elements provided in row on the internal edges of a pair of tapes opposed right and left, and by engaging the both fastening elements each other at the upper or below direction crossing at right angle with respect to the surface of a tape.

Still another object is to provide a solid slide fastener combined with a slider into which the both fastening elements are introduced with difference steps up and down and which sends out the connected fastening elements from the same plane.

The other objects of the present invention will become more apparent from the following detailed description and the accompanying drawings.

BRIEF DESCRIPTION OF THE DRAWINGS

FIGS. 1A and 1B show a "Prior Art" fastener, in which FIG. 1A is a partial plan view of the fastener and FIG. 1B is a front view thereof in a state that the union of fastening elements is disengaged.

FIGS. 2A and 2B show the first embodiment of a solid slide fastener according to the present invention, in which FIG. 2A is a plan view and FIG. 2B is a partially enlarged perspective view.

FIGS. 4A to 4C show a solid slide fastener according to the present invention, which is combined with a slider, in which FIG. 4A is a plan view, FIG. 4B is a front view and FIG. 4C is a sectional view taken along line A—A of FIG. 4A.

FIGS. 5A and 5B show the second embodiment of the present invention, in which FIG. 5A is a plan view of a principal part thereof and FIG. 5B is an enlarged perspective view of the principal part.

FIGS. 8A to 8C show the combination of the fastening elements in the third embodiment with a slider, in which FIG. 8A is a plan view thereof, FIG. 8B is a front view, FIG. 8C is a sectional view taken along line B—B of FIG. 8A.

DESCRIPTION OF THE PREFERRED EMBODIMENTS

Prior to the explanation of the embodiments according to the present invention, the problems of the conventional slide fastener are discussed.

Figure 1A:
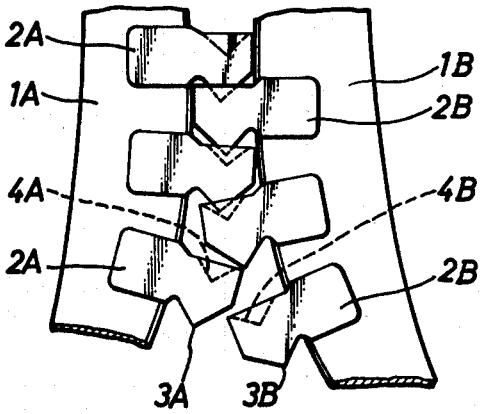
Figure 1B:
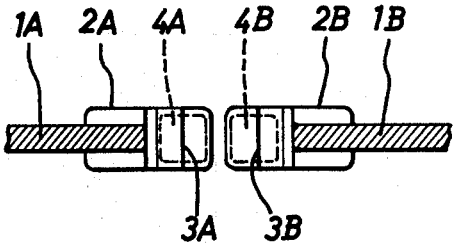
PRIOR ART Fig.1B

The conventional slide fastener has such a structure that as shown in FIG. 1A, fastening elements 2A, 2B are respectively provided, in row, on the opposed edges of a pair of tapes 1A, 1B; the phases of the elements 2A, 2B on the tapes 1A, 1B are staggered at a specific distance, and the front and rear faces of the respective elements 2A (2B) are provided with projection 3A (3B) and recess 4A (4B) which receives the projection of the opposed element, respective elements 2A, 2B come close by means of an introduction of a slider (not shown) at the same plane with the tapes 1A, 1B, as shown in FIG. 1B, and then the projection 3A (3B) and the recess 4B (4A) are interlocked, thereby engaging the elements.

In case that the connection of the both elements 2A, 2B is so made on the same plane with the tapes, as mentioned above, there occurs such a problem that the connection is easily disengaged by comparatively small force when a force is given to a direction which separates from a respective tape 1A, 1B. Of fource, the degree of the connection may be affected by the strength of a resistance of the projections 3A (3B) and the recesses 4A (4B) provided on each elements 2A, 2B, so that it is possible to design a fastener having fastening elements which is hard to be separated by the strong connection of the recesses and the projections. However, such a strong connection hinders the function of the fastener itself because the sliding movement of the slider does not become easily to interlock or disengage elements 2A, 2B each other.

Therefore, in the conventional structure of a fastener, there is a limit to a resisting force against external force, so that the usage of the conventional slide fastener is restricted by itself.

Figure 2A:
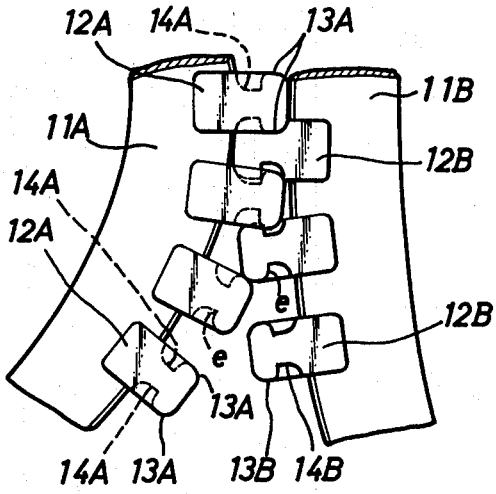
Figure 2B:
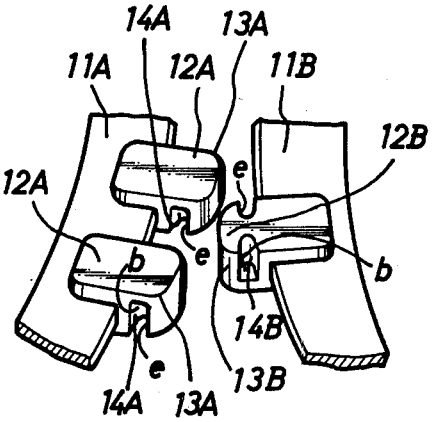

FIGS. 2A and 2B show the first embodiment of the present invention. In FIGS. 2A, 2B, rows of the fastening elements 12A, 12B are respectively provided on the opposed-inside edges of a pair of slender tapes at certain distance. Moreover, the positions of right and left-side fastening elements on respective tapes 11A, 11B are in such a conditions that the phases of the right and left-side fastening elements are staggered respectively.

The fastening elements 12A, 12B have the same shape and are respectively provided on each tape 11A, 11B in such a manner that the installing direction of the element on one tape is different from that of the element on the other tape.

Each element 12A (12B) is provided, at the top-both sides of the other end, with flanges 13A, 13A (13B, 13B) having engaging edge e which is parallel to the direction of the tape. Grooves 14A, 14A (14B, 14B) having a bottom, which receives the flange 13B or 13A on the opposed-side element 12B (12A) are provided on the both side of the top portion following to the flange 13A (13B), in the up or down direction with respect to the surface of the tape. The embodiment shows an example of a case that by the provision of the groove 14A (14B) on the both sides of the fastening element 12A (12B), the flange 13A (13B) are relatively formed. Therefore, the edge e of each flange 13A (13B) serves as an engaging edge for the groove 14A (14B) which receives the opposed flange, too. Furthermore, the groove 14A has a bottom b at its lower portion and the groove 14B has a bottom b at its upper portion.

FIG. 2B shows an example of a case that between adjacent fastening elements 12A, 12A provided on one tape 11A is introduced the element 12B provided on the other tape 11B from the under side; the both flanges 13B, 13B of the top portion of the element 12B are interlocked in the grooves 14A, 14A on each one side of the adjacent elements 12A, 12A and at the same time, the flanges 13A, 13A on each one side of the top portion of each element 12A, 12A are received within the grooves 14B, 14B on the both sides of the element 12B, thereby engaging the edges e, e of the flanges 13A, 13B so as to be interlocked each other. When the flange 13B is inserted into the groove 14A of the opposed element 12A from the under side, the escape of the flange 13B can be avoided by the upper bottom b of the groove 14A, and the other element 12A is supported by the under bottom b of the groove 14B, thereby the engaging state can be maintained.

Figure 3A:
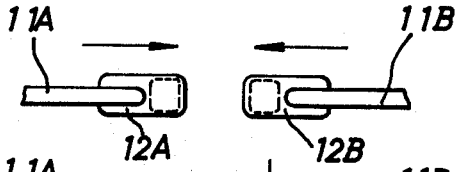
FIGS. 3A to 3D illustrate diagrams showing the order of the connection of the fastener.
Figure 3B:
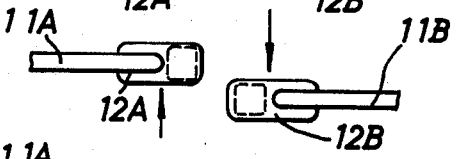
Figure 3C:
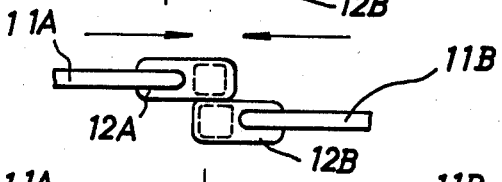

FIGS. 3A to 3D show the process for joining the fastener. Firstly, in FIG. 3A, the rows of the right and left fastening elements 12A, 12B are kept on the same vertical plane. As shown in FIG. 3B, the rows of the both elements 12A, 12B are relatively displaced upwardly and downwardly. Next, as shown in FIG. 3C, the rows of the elements 12A, 12B shifted up and down are moved in parallel so close to a position where the rows of the elements 12A, 12B are piled one another.

Figure 3D:
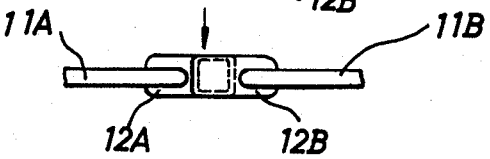

Finally, as shown in FIG. 3D, horizontal direction force is given to the elements 12A, 12B so as to pressurizedly insert one element 12A into the other element 12B, and the flange 13A (13B) of the both elements 12A, (12B) are interlocked into the groove 14B (14A) so as to be returned to the same vertical plane, thereby the strong union of the both fastening elements 12A, 12B can be obtained.

Figure 4A:
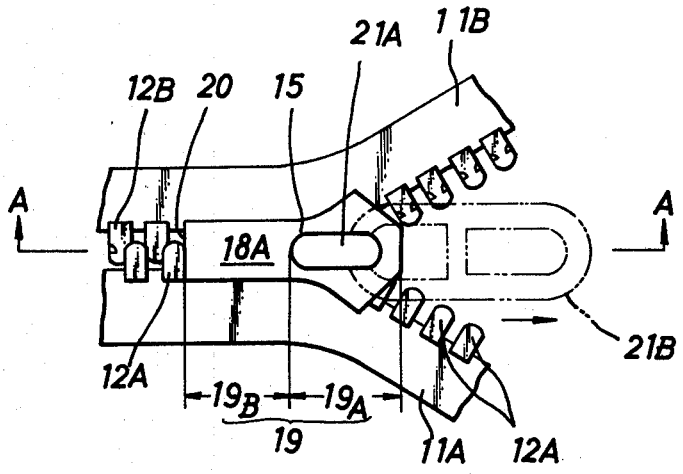
Figure 4B:
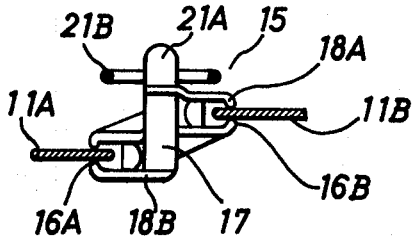

FIG. 4A is a whole diagram of a fastener which carries out the interlocking of the elements 12A, 12B as shown in FIGS. 3A to 3D. A slider 15 for accomplishing the above mentioned purpose, as shown in FIG. 4B, has such a structure that introduction openings 16A, 16B are opened at one end between upper plate 18A and bottom plate 18B in different steps so as to receive the fastening elements 12A, 12B which are devided right and left by a central separation pole 17 at the front in cross section (in this FIG. 4B, the introduction opening 16B positions at upper portion and the opening 16A is opened at lower portion.); and induction passage 19 is formed between the upper plate 18A, bottom plate 18B, which induces the rows of the fastening elements 12A, 12B towards outlet 20 opened at the opposite side of the openings. The induction passage 19 consists of a horizontal induction part 19A and a perpendicular induction part 19B. The horizontal induction part 19A moves the right-and-left fastening elements 12A, 12B introduced from the openings 16A, 16B with different up-and-down steps in the horizontal direction and lies the elements 12A, 12B up and down as shown in FIG. 3C. The horizontal induction part 19A is formed between the horizontal portions of the upper plate 18A and bottom plate 18B the width of which is gradually reduced along the longitudinal direction. On the other hand, the perpendicular induction part 19B moves relatively the both fastening elements 12A, 12B lied up and down in the up and down direction, and makes the both elements 12A, 12B interlock each other. The perpendicular induction part 19B is formed between the oblique portions of the upper plate 18A and bottom plate 18B following to the horizontal induction part 19A. The upper plate 18A and bottom plate 18B are connected by the central pole 17 at the inlet portion of the horizontal induction part 19A. A fitting member 21A is provided on the top surface of the upper plate 18A. Moreover, an operational hook 21B is connected with the fitting member 21A. When the hook 21B is pulled in the arrow direction of FIGS. 4A and 4C, the fastening elements 12A, 12B provided on respective tapes 11A, 11B are received with different steps into the slider 15 through the introduction openings 16A, 16B provided with differently up-and-down steps. During the time that the elements 12A, 12B pass in the induction passage 25, their direction is controlled by the horizontal induction part 19A and the perpendicular induction part 19B.

While they are sent out from the outlet 20 opened at the opposite side, the rows of the both fastening elements 12A, 12B come to meet each other and are introduced in a position on a plane. Thereby, the fastening elements 12A, 12B are strongly joined each other by forcedly receiving the pressurized force from the inside surfaces of the upper plate 18A and bottom plate 18B.

On the other hand, when the engagement of the joined fastening elements 12A, 12B is separated, the hook 21B is pulled in a direction opposite to the above mentioned direction, whereby the both fastening elements 12A, 12B go into the slider through the outlet 20. To the contrary ways mentioned above, the both fastening element 12A, 12B moves relatively up and down and the engagement thereof is released at the perpendicular induction part 19B. Moreover, the elements 12A, 12B are separated right and left at the horizontal induction part 19A, so that they are sent out right and left from the slider 15 through the introduction of the separation pole 17.

In the above embodiment, such examples were shown that the elements 12A, 12B are provided on the tapes 11A, 11B, respectively in such a manner that the phases between the row of the fastening elements 12A and the row of the elements 12B become to be staggered.

Figure 4C:
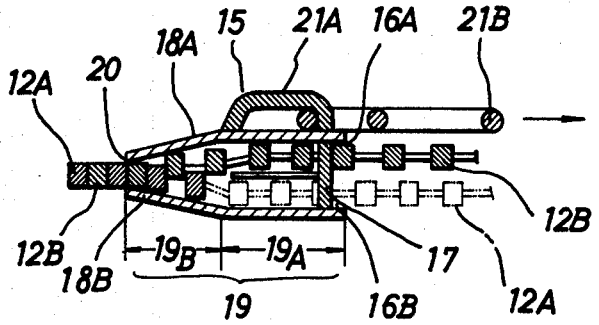
Figure 5A:
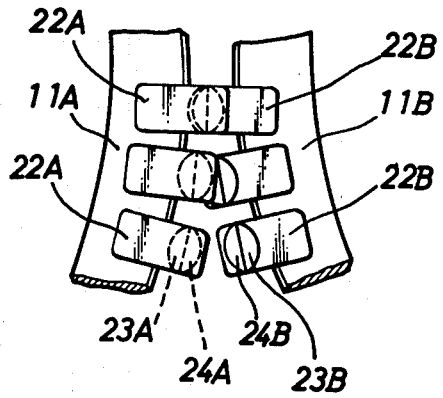
Figure 5B:
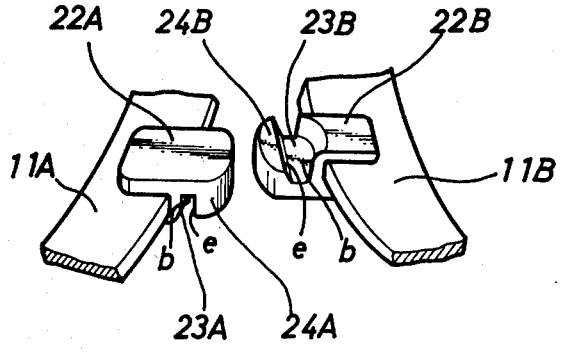

In FIGS. 5A and 5B, a case of the second example that the right and left fastening elements 22A, 22B are provided on the same plase, is shown. That is, in this example, the elements 22A, 22B has the same shape and are provided on the tape 11A, 11B, respectively, in inverse directions. Each element 22A (22B) has a flange 24A (24B) having edge e parallel to the direction of the tape on the head of its under face (or upper face). Furthermore, grooves 23B, 23A receiving the flanges 24B, 24A of the opposed elements 22B, 22A are provided in their inside. The groove 23A has a upper bottom b and the groove 23B has a lower bottom b. Therefore, by applying the slider as shown in FIGS. 4A to 4C and in accordance with the order as shown in FIGS. 3A to 3D, the left and right elements 22A, 22B are moved in parallel to the direction where they become close, from a state that the positions thereof are staggered up and down, and then they are piled. In their piled state, the both elements 22A, 22B are interlocked as a whole and edges e of the planges 24A, 24B are engaged each other thereby the joint can be made.

Figure 6:
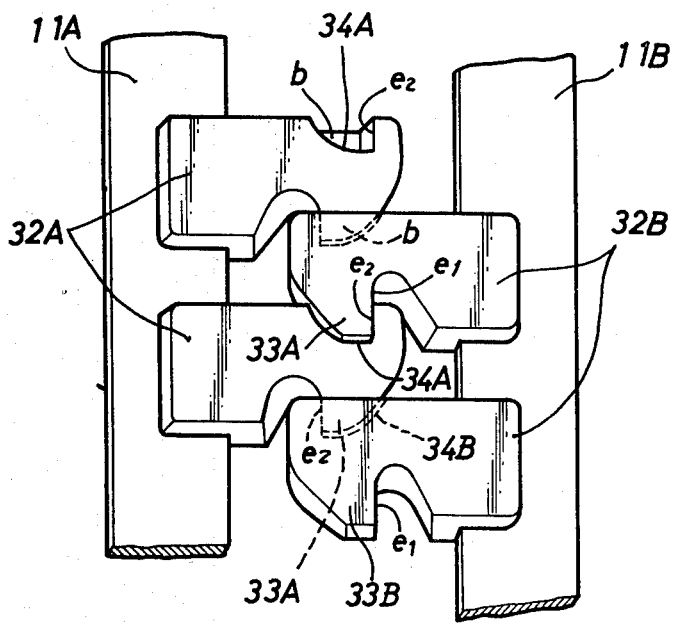
FIG. 6 shows an enlarged plan view of the third embodiment of the solid slide fastener according to the present invention.

FIG. 6 shows the third embodiment of the present invention. Respective fastening elements 32A, 32B provided on the left and right tapes 11A, 11B at their ends have respectively flange 33A, 33B having edges $e_1$ parallel to the directions of the tapes at the one side of their outward top portions. On the other sides of the flanges are positioned grooves 34A, 34B having at the upper face or down face, which have edge $e_2$ parallel to the directions of the tapes at their insides for receiving the flanges 33A, 33B of the opposed fastening elements 32A or 32B with pressure.

The grooves 34A has an upper bottom b and the groove 34B has lower bottom b.

In this embodiment, the edges $e_1$ of the flanges 33A of the fastening elements 32A in one side row are arrested by the edges $e_2$ of the grooves 34B of the fastening elements 32B in the other side row; and the edges $e_1$ of the flanges 33B of the elements 32B are arrested by the edges $e_2$ of the grooves 34A of the elements 32A. In same way as the aforementioned examples, joining or separation of each fastening element is carried out by the application of the slider as shown in FIGS. 4A to 4C and by the process as illustrated in FIGS. 3A to 3D.

In the example, as shown in FIGS. 3A to 3D, the fastening elements and the tapes provided with the elements are kept in a position on the same plane; the tapes with the elements are staggered up and down with different steps; and next, the elements are joined by engagement from the up and down direction.

In this case, when the both elements are received in the slider and joined by the sliding movement of the slider, the up and down different steps occur on the tapes just in front of the slider.

The following embodiment shows an example of such a case that even when the elements are received into the slider, the connection of the fastening elements is made without the up-and-down staggering with different steps.

This example is explained using the fastening elements as shown in FIG. 6.

Figure 7A:
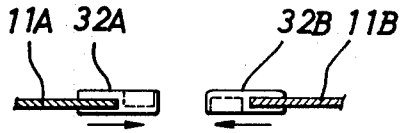
FIGS. 7A to 7D are diagrams showing the joint state of the fastener in the third embodiment.
Figure 7B:
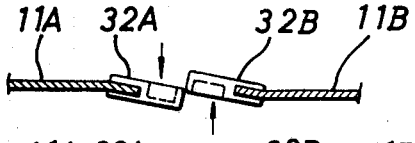
Figure 7C:
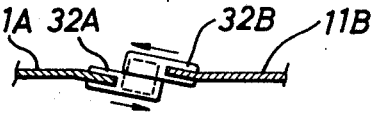
Figure 7D:
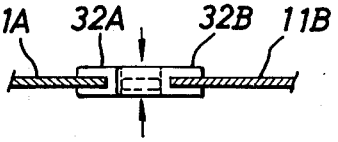

FIGS. 7A to 7D show other embodiment of the state at joining the fastener. That is, in FIG. 7A, the left and right fastening elements 32A, 32B kept on the same plane are horizontally maintained, and then as shown in FIG. 7B, the both tapes 11A, 11B are held horizontally and at the same time, only the elements 32A, 32B are inclined as a specific angle with same direction. And, as shown in FIG. 7C, the elements 32A, 32B are horizontally moved to a position where they come close and are laid up and down. Moreover, as shown in FIG. 7D, the flanges 33A, 33B of the both fastening elements 32A, 32B are inserted, with pressure into the grooves 34A, 34B each other so as to insert the flange of one element into the groove of the other element with up and down pressure. Finally, by returning the elements to the horizontal plane, the engagement of the elements 32A, 32B is completed.

Figure 8A:
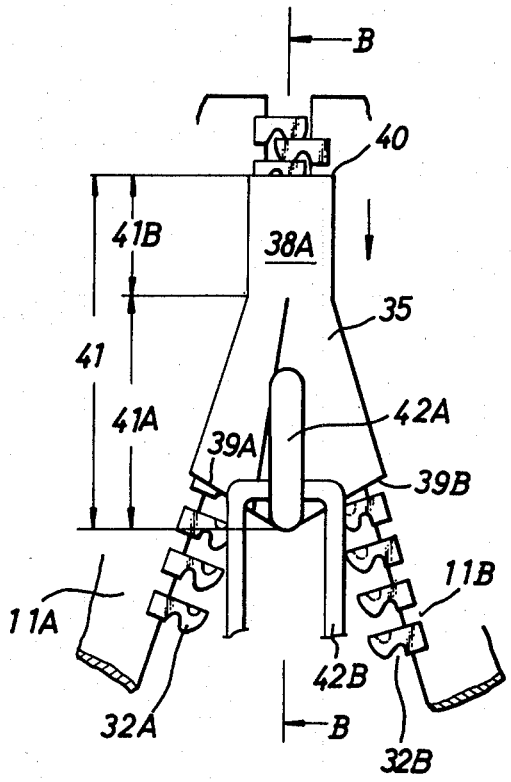
Figure 8B:
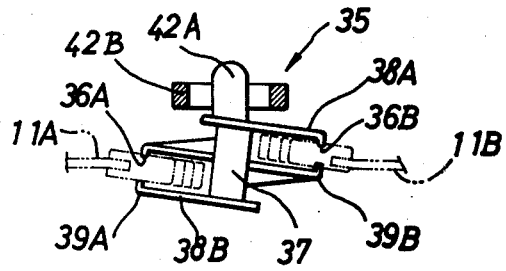
Figure 8C:
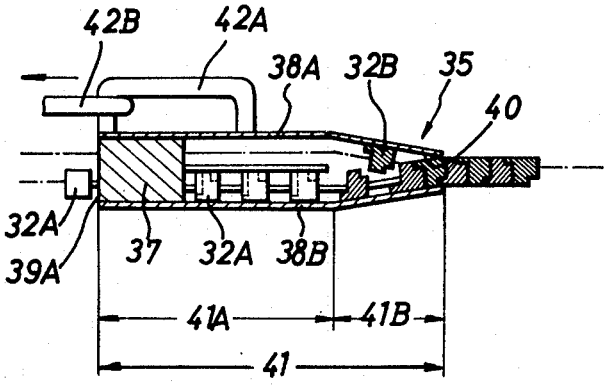

FIGS. 8A to 8C show the structure of a fastener for making the connection of the both fastening elements 32A, 32B as shown in FIGS. 7A to 7D. A slider 35 for accomplishing the above purpose consists of upper plate 38A and bottom plate 38B connected by a right-left separation pole 37. On the both sides of said plates 38A, 38B, tape-introduction grooves 36A, 36B for introducing the tapes 11A, 11B are opened over the whole length of the slider on the same plane. On one end (front end) of the slider, introduction openings 39A, 39B for receiving left and right elements 32A, 32B at the border of the central separation pole 37 seeing from the front of the slider 36, and opened in parallel with inclination at a specific angle.

FIG. 8B shows a case that the introduction opening 39B is opened at upper position and the opening 39A is opened at lower position, they are inclined in the same direction at a specific angle and are opened, respectively.

Between the upper plate 38A and bottom plate 38B, an outlet 40 opens at the opposite side of the introduction openings 39A, 39B. Between the both openings 39A, 39B and the outlet 42, induction passage 41 for inducing the rows of the elements 32A, 32B is provided. The induction passage 41 consists of an inclined-horizontal induction part 41A following to the introduction openings 39A, 39B and a perpendicular induction part 41B which come to meet the both openings 39A, 39B. The inclined-horizontal induction part 41A is formed by gradually reducing the right and left width from the sides of the openings 39A, 39B along the longitudinal direction. The perpendicular induction part 41B is formed by gradually narrowing the up and down distance of said plates 38A, 38B following to the inclined-horizontal induction part 41A.

On the top surface of the upper plate 38A is provided a fitting member 42A, which is connected with an operational hook 42B. Therefore, when the hook 42B is pulled in an arrow direction in FIGS. 8A and 8C, the fastening elements 32A, 32B forced each other on the same plane as shown in FIG. 7A are first received into the introduction openings 39A, 39B in inclined mode as shown in FIG. 7B. During the time that the fastening elements 32A, 32B pass through the induction passage, they come close each other at the inclined-horizontal induction part 41A as shown in FIG. 7C.

When the fastening elements 32A, 32B receive pressure from up and down portion at the perpendicular induction part 41B and are sent out of the outlet 40 opened at the opposite side, the elements 32A, 32B are strongly connected each other as shown in FIG. 7D.

On the contrary way, the elements 32A, 32B are separated up and down; they are further divided right and left by means of the inclined-horizontal induction part 41A and the introduction of separation pole 37; and then they are sent out of the slider 35 through the introduction openings 39A, 39B.

According to the above embodiment, since the engagement or disengagement of the both fastening elements is performed by inclining the elements at a specific angle from their bases with respect to the tapes due to the control of the slider, right and left staggering does not occur on the tapes equipped with the elements near the slider and rather, in the entirely similar way as a conventional fastener with the plane connection, the engagement or disengagement of the elements can be carried out remaining the tape on the same plane.

Moreover, such a case that the connection of the fastening elements on the both rows is made not only at right angle but at angles near the right angle, is included within the range of the present invention.

Test for tensile force of right-angle direction with respect to running direction, which is generally carried out, was made to solid slide fasteners capable of effecting strong union according to the present invention, the sizes of which are approximately same with those of the conventional fasteners in types of Japanese Industrial Standards Nos. 2 and 5. As the result of this test, it was found that separation tensile force of the fasteners of the present invention can maintain the strength of 220% to 300% in comparison with the conventional ones.

The forms of the fastening elements applied to the present invention are not limited to the above mentioned embodiments. The positiones and shapes of the flanges on the elements and of the grooves into which the flanges is inserted with pressure can be freely designed. In short, when such a structure is only provided that against the tensile direction mainly acted to the tape, the connection of the elements are accomplished from the right-angle direction with respect to the plane of the tape so that the escape of the elements toward tape can be avoided, any shapes of the flange and grooves is all right. Moreover, the slide to be combined with the fastening elements can be used in both the structures of FIGS. 4A to 4C and FIGS. 8A to 8C.

According to the present invention, the usage range of a fastener which is, so far, limitted to an opening and closing mechanism of clothing, pouch, etc., to which only comparatively small force can be given, is widely enlarged, and a fastner which can be used for the connection of inductrial products, has great inerlockability and good duability.

What is claimed is:

1. A firm grip slide fastener comprising:

a first flexible tape and a second flexible tape generally co-planar with and in opposed relation to the first tape;

a plurality of independent rigid fastening elements secured to an edge of said first tape to form a first row of fastening elements;

a plurality of independent rigid fastening elements secured to an edge of said second tape to form a second row of fastening elements;

each fastening element of said first row having a head at an outer end thereof and a groove inwardly of said head, said groove opening in a first direction transverse to the plane of said first tape;

each fastening element of said second row having a head at an end thereof and a groove inwardly of the head, said groove opening in a second direction opposite to said first direction and transverse to the plane of said second tape;

said grooves of the fasteners of the first row receiving the heads of the fasteners of the second row, and said grooves of the fasteners of the second row receiving the heads of the fasteners of the first row to lock the rows together against separation by a pull exerted outwardly in the plane of said tapes;

slider means for interlocking said rows of fasteners, said slider means comprising means for sequentially moving each element of one row with respect to opposed elements of the other row to a position in a plane parallel with and overlapping the opposed element of the second row, by flexing at least one of said tapes, means for locking said elements together by moving the element of at least one row in a direction toward and perpendicular to said parallel overlapping elements of the other row to lock the elements of the first row to the elements of the second row, said fastening elements of each row being spaced apart, and said fastening elements of said first row being staggered with respect to the fastening elements of said second row so that the fastening elements of said rows interfit with each other, each fastening element comprising a pair of grooves one on each side of each element, said grooves defining oppositely facing flanges of said heads, the flanges of each element of each row engaging in the grooves of adjacent elements of the other row.

2. A firm grip slide fastener comprising:

a first flexible tape and a second flexible tape generally co-planar with and in opposed relation to the first tape;

a plurality of independent rigid fastening elements secured to an edge of said first tape to form a first row of fastening elements;

a plurality of independent rigid fastening elements secured to an edge of said second tape to form a second row of fastening elements;

each fastening element of said first row having a head at an outer end thereof and a groove inwardly of said head, said groove opening in a first direction transverse to the plane of said first tape;

each fastening element of said second row having a head at an end thereof and a groove inwardly of the head, said groove opening in a second direction opposite to said first direction and transverse to the plane of said second tape;

said grooves of the fasteners of the first row receiving the heads of the fasteners of the second row, and said grooves of the fasteners of the second row receiving the heads of the fasteners of the first row to lock the rows together against separation by a pull exerted outwardly in the plane of said tapes;

slider means for interlocking said rows of fasteners, said slider means comprising means for sequentially moving each element of one row with respect to opposed elements of the other row to a position in a plane parallel with and overlapping the opposed element of the second row, by flexing at least one of said tapes, means for locking said elements together by moving the element of at least one row in a direction toward and perpendicular to said parallel overlapping elements of the other row to lock the elements of the first row to the elements of the second row, said fastening elements of each row being spaced apart, and said fastening elements of said first row being staggered with respect to the fastening elements of said second row so that the fastening elements of said rows interfit with each other, each fastening element comprising a groove at one side and a head at the other side, each head of the elements of each row engaging in a groove of an opposed element of the other row.

3. A firm grip slide fastener according to claim 1 or claim 2 wherein said means of said slider for sequentially moving each element comprises, means for lifting the elements of one row and simultaneously depressing opposed elements of the other row.

4. A firm grip slide fastener according to claim 1 or claim 2 wherein said means of said slider for sequentially moving each element comprises, means for tilting the elements of one row upwardly while simultaneously tilting the elements of the other row downwardly.

* * * * *